US007118380B1

(12) United States Patent
Kraz et al.

(10) Patent No.: US 7,118,380 B1
(45) Date of Patent: Oct. 10, 2006

(54) CONNECTOR ARRANGEMENT IN WRIST STRAP MONITORS

(75) Inventors: Vladimir Kraz, Santa Cruz, CA (US); Fatjon Gurga, San Jose, CA (US)

(73) Assignee: Credence Technologies, Inc., Soquel, CA (US)

( * ) Notice: Subject to any disclaimer, the term of this patent is extended or adjusted under 35 U.S.C. 154(b) by 0 days.

(21) Appl. No.: 11/105,257

(22) Filed: Apr. 13, 2005

Related U.S. Application Data

(60) Provisional application No. 60/561,942, filed on Apr. 13, 2004.

(51) Int. Cl.
*H01R 33/00* (2006.01)

(52) U.S. Cl. ..... 439/37; 340/649; 340/650; 324/509; 324/510

(58) Field of Classification Search ..... 435/37; 361/212; 340/649, 650, 549; 324/509, 510
See application file for complete search history.

(56) References Cited

U.S. PATENT DOCUMENTS 5,051,732 A * 9/1991 Robitaille ..... 340/650
5,057,965 A * 10/1991 Wilson ..... 361/212
5,164,674 A 11/1992 Bakhoum
5,218,306 A 6/1993 Bakhoum
5,247,420 A 9/1993 Bakhoum
5,408,186 A 4/1995 Bakhoum
5,519,384 A 5/1996 Chanudet et al.
5,952,931 A * 9/1999 Chotichanon et al. ..... 340/649
6,008,979 A 12/1999 Mykkanen et al.
6,930,612 B1 * 8/2005 Kraz et al. ..... 340/649

OTHER PUBLICATIONS

Product Description for Credence Technologies WS Aware product, pp. 1-2, published in 2002.
Product Description for Novx Corporation Series 400 Product, pp. 1-2, printed from web on Apr. 12, 2004.
http://www.credencetech.com/WS_Aware/WS_Aware.pdf.
http://www.novxcorp.com/series_400.htm.

* cited by examiner

*Primary Examiner*—Gary F. Paumen
(74) *Attorney, Agent, or Firm*—DLA Piper Rudnick Gray Cary US LLP

(57) ABSTRACT

A connector assembly for a wriststrap jack is provided wherein the jack may be easily replaced in accordance with the invention.

14 Claims, 3 Drawing Sheets

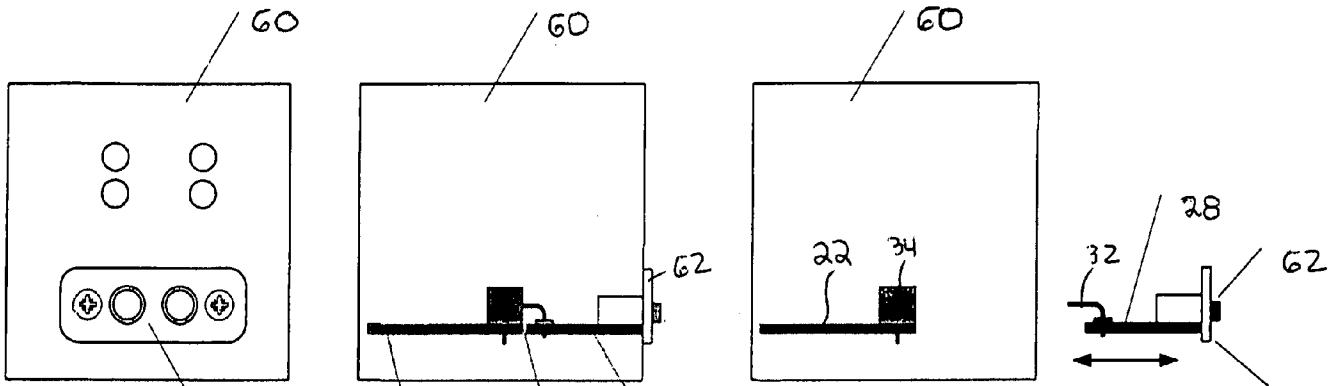
Figure 8
Figure 9
Figure 10
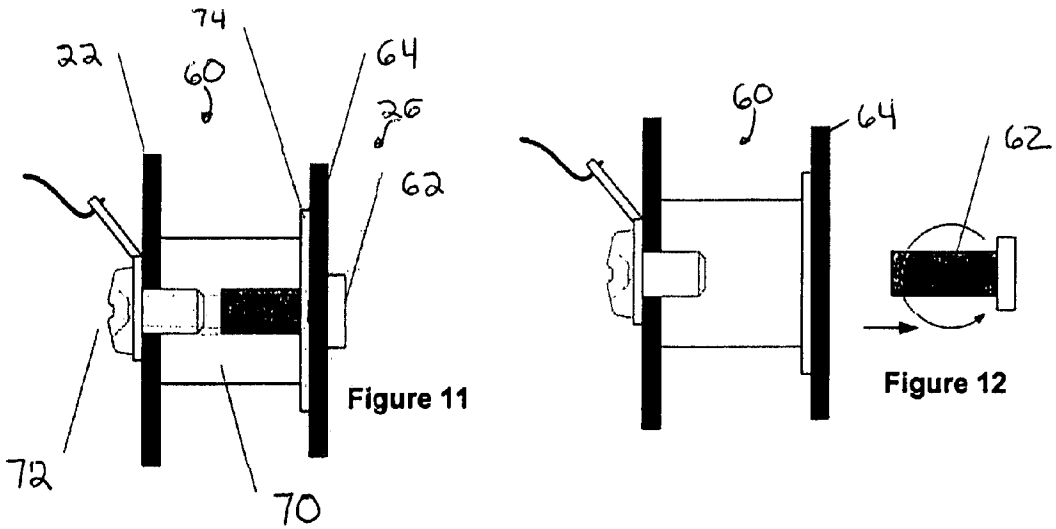
Figure 11
Figure 12

CONNECTOR ARRANGEMENT IN WRIST STRAP MONITORS

PRIORITY CLAIM/RELATED APPLICATIONS

This application claims priority under 35 USC 119(e) to U.S. Provisional Patent Application Ser. No. 60/561,942, filed on Apr. 13, 2004 and entitled "Improved Connector Arrangement in Wrist Strap Monitors" which is incorporated herein by reference.

FIELD OF THE INVENTION

The invention relates generally to a monitoring system that uses a wriststrap and in particular to an improved connector for a wriststrap monitor.

BACKGROUND OF THE INVENTION

Wrist straps are frequently used for dissipation of accumulated static charges from personnel during handling of static-sensitive electronic components and alike. In critical environments to assure that operators wear wrist straps properly, wrist strap monitors are often utilized. Some examples of such monitors can be found at the following links:

http://www.credencetech.com/WS_Aware/WS_Aware.pdf http://www.novxcorp.com/series_400.htm.

Wrist strap monitors utilize jacks for connecting wrist straps either on the monitor itself or on a remote terminal, such as in 3M's Replacement Remote Input Jack 732 and others. One problem with the jacks is that they wear out and fail after a certain length of time. This problem especially affects 3.5 mm dual wriststrap jacks, such as 3M's Dual Conductor Wrist Band model 4720.

The replacement of the jack involves either replacing the entire terminal, repairing the terminal, or repairing the monitor itself if the jacks are installed inside the monitor. The replacement of the entire terminal is an expensive endeavor while repairing the monitor or the jacks is a little less expensive but is labor-intensive and reduces the overall reliability of the device. The biggest problem is the soldering and unsoldering of the jack assembly that requires special tools and skills and weakens the printed circuit board on which the jacks are attached so that the printed circuit board becomes unusable after replacement of the jacks by soldering.

Thus, it is desirable to provide an improved connector arrangement for a wriststrap monitor and it is to this end that the present invention is directed.

SUMMARY OF THE INVENTION

The proposed invention introduces easily-removable and replaceable jack arrangement that greatly reduces the cost of owning and maintaining the wrist strap monitor by allowing replacement of only the part of the terminal that contains the jack(s). Preferably, the part that is replaceable includes components that are most likely to fail with prolonged use.

Thus, in accordance with the invention, a connector assembly for a wriststrap monitor is provided wherein the connector assembly has an integrated member and a removable member, The integrated member has a mating connector and a monitor connector and the removable member has a second mating connector and a jack into which a wriststrap connector may be plugged. The integrated member and the removable member are capable of being mechanically coupled to each other using the mating connector and the second mating connector so that the monitor connector is electrically connected to the jack.

In accordance with another aspect of the invention, a connector assembly for a wriststrap monitor is provided in which the connector assembly has an integrated member and a-removable member having a monitor connector and a jack into which a wriststrap connector may be plugged, the monitor assembly and jack being electrically coupled. The integrated member and removable member are removably coupled to each other.

In accordance with yet another aspect of the invention, a method for replacing a wriststrap jack for an wriststrap monitor is provided. In order to replace the jack, the jack assembly is removed from the wriststrap monitor. Then, a new jack assembly is inserted into the wriststrap monitor in order to replace the wriststrap monitor jack.

In accordance with a different aspect of the invention, a wriststrap monitor is provided that includes a monitor that monitors the voltage associated with a wriststrap. The monitor also has a jack assembly that is capable of connecting the wriststrap to the monitor wherein the jack assembly being removably connected to the monitor so that the jack assembly is replaceable.

BRIEF DESCRIPTION OF THE DRAWINGS

FIG. 8 depicts a monitoring unit with integrated jacks for the wriststraps. Removable board with the jacks is shown in the front.

FIG. 9 depicts a side view of the monitoring unit of FIG. 8. Inside there are integrated board or other similar arrangement to which the removable board is electrically connected via easily-disengageable and engageable connector arrangement.

FIG. 10 depicts the monitoring unit of FIG. 9 where the removable board is taken out.

FIG. 11 depicts the monitoring unit where the jack is removable by itself.

FIG. 12 depicts the monitoring unit of FIG. 11 with the jack removed.

DETAILED DESCRIPTION OF A PREFERRED EMBODIMENT

The invention is particularly applicable to a connector arrangement for a wriststrap monitor (for ground or operator voltage) and it is in this context that the invention will be described. It will be appreciated, however, that the connector arrangement in accordance with the invention has greater utility since the connector arrangement may be used with other mechanisms, monitors, machines, etc. in which a cord is releasably connected to the mechanisms, monitors or machines. For example, the connector arrangement in accordance with the invention may be used to connect a wriststrap of a piece of machinery to a kill switch.

A wriststrap monitor is a well known device that monitors the grounding of an individual, workbench or tool in an electrostatic discharge (ESD) safe environment, such as disk drive assembly, GMR head handling, a semiconductor fabrication/assembly process, reticle handling, flat panel fabrication, laser diodes/fiberoptics, electronic assembly, industrial robots, medical and military applications. In fact, a monitor may be used in any environment in which ESD is an issue. The monitor permits both the wriststrap voltage and the grounding to be monitored. For example, the monitor can monitor if an operator is properly wearing a wriststrap and if an operator has excessive body voltage.

As used herein, an "integrated member" is not easily removed and replaced, in contrast to a "removable member." The removable member usually includes a means for attaching to the integrated member, which may be mechanical (e.g., a clip, a screw) or adhesive. Thus, in the preferred embodiment of the monitor, the monitor may include an integrated member while a replaceable connector assembly may be the removable member that may be replaced when it wears out.

Figure 1:
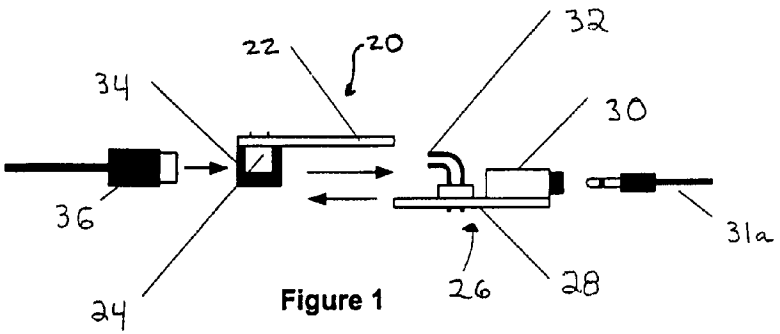
FIG. 1 depicts a two-board embodiment of the multi-part wrist strap monitor unit, wherein one board is integrated with the unit and another board is removable.

In the embodiment of FIG. 1, an integrated member 20 includes an integrated board 22 (such as a printed circuit board), electrical components for operation (not shown), and one or more connectors 24 for mating with a removable member 26. The removable member 26 includes a removable board 28, one or more jacks 30 (into which a cable 31*a* of a wriststrap may be plugged) mounted on the removable board, and one or more receptacle connectors 32 for mating with the integrated member. As shown in FIG. 1, the integrated member 20 may also include (for the embodiment that is used with a monitor device) a connector 34 to the monitor into which a cable 36 with a connector from the wriststrap monitor is plugged in order to connect the wriststrap monitor to the wriststrap. In this embodiment, when the integrated member and removeable member are connected to each other, there is an mechanical connection that holds the integrated member and the removeable member together as well as an electrical connection so that the wriststrap (though the cable 31*a*) is electrically connected to the monitor through the cable 36.

Figure 2:
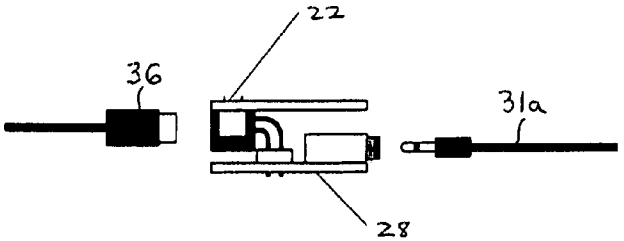
FIG. 2 depicts the two-board embodiment of FIG. 1 mated in a "sandwich"-like configuration.
Figure 3:
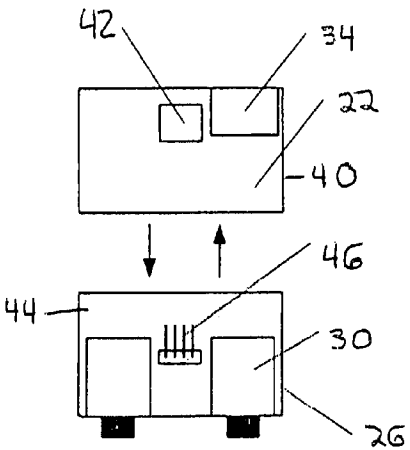
FIG. 3 is a top view of the two boards of FIG. 1.
Figure 4:
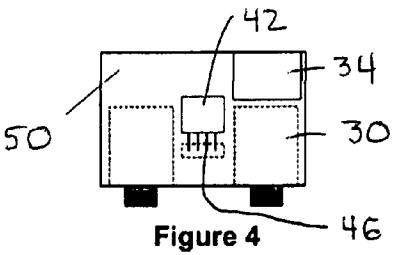
FIG. 4 is top view of the "sandwiched" boards of FIG. 2.

As shown in FIG. 2, the two members 22, 28 are connected in a "sandwich"-like configuration forming one circuit in which the receptacle connectors 32 are mechanically connected to the connector 34. It would be obvious to those skilled in art that arrangements other than the "sandwich"-like configuration shown in this embodiment are possible and those other connection arrangements are within the scope of this invention. FIG. 3 illustrates another embodiment of the connection arrangement in which the stationary board 22 and the monitor connector 34 may be housed in an enclosure 40 that also has a board connector 42 that may be located at the bottom of the board. The removable member 26 has the jacks 30 that are inside of a second enclosure 44 with a second connector 46 so that the board connector 42 and the second connector 46 that mates with each other to form an enclosure 50 as shown in FIG. 4. In accordance with the invention, when the jack fails, the removable member is disconnected from the integrated member and discarded so that a new removable member (the jack assembly) can be plugged into the monitor. This avoids the need to unsolder and resolder the jacks to the printed circuit board as is conventionally done.

Figure 5:
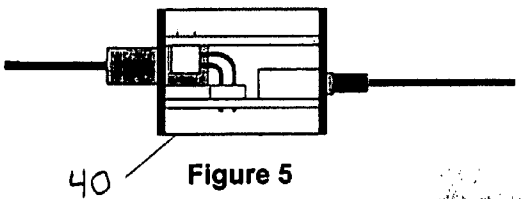
FIG. 5 shows the "sandwiched" boards of FIG. 2 in an enclosure.
Figure 6:
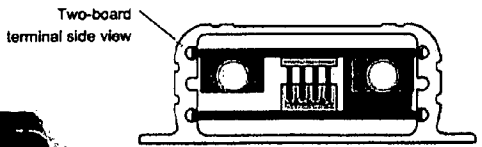
FIG. 6 is a side view of the arrangement of FIG. 5.
Figure 7:
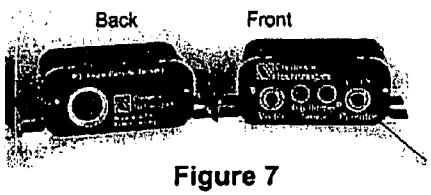
FIG. 7 depicts the front and back view of the wrist strap monitoring unit.

FIGS. 4, 5 and 6 show that the two members 22, 28 may be housed in the enclosure 50 to protect the members 22, 28. The enclosure that is shown has four side panels, an upper panel, and a lower panel, although other embodiments are possible. A cable from the monitor is connected to the integrated member 22 and wrist straps are plugged into the removable member 28. FIG. 7 shows an actual implementation of the completed enclosure 50.

In accordance with this embodiment of the invention, when a jack fails, a side panel is removed, and the removable member is disconnected and removed. A new removable member (also called the "replacement member") with the jacks is attached, and the side panel is reinstalled. Unlike with the conventional monitoring unit, the multi-section monitoring unit of the invention allows the non-functional portion (usually the jack) to be replaced easily and at a low cost. The end user who purchases the multi-section monitoring unit may later purchase just the replacement member at a price that is a fraction of the price of the entire monitoring unit. Further, since the replacement member is designed to be "plugged into" the position of the old removable member, the replacement is easy and quick. No enclosure, side panel, or integrated electronic components needs to be disposed of. Only the less expensive portions and the non-functional portion are discarded and replaced, keeping the cost low. The replacement operation can be performed on site with minimal disruption. Alternatively, in the embodiments shown, the removable member with the jack(s) and the front panel may be a single piece and may be discarded when the jack(s) fail.

In some embodiments, the body of a wrist strap monitoring unit 60 includes jacks 62, as shown in FIG. 8. In these cases, a removable member similar to the one in FIGS. 1–7 is installed in such way that its replacement is similarly easy and inexpensive, as shown in FIGS. 9 and 10. The embodiment shown in FIGS. 8, 9, and 10 do not include two boards 22, 28 arranged in a sandwich configuration. Rather, the two boards are arranged in a plane. The two members are connected with the connector 32 mounted on the removable board 28. As with the other embodiment, the jack 62 has a front panel 64 which may be removed when the jack is replaced as shown in FIG. 10 and then replaced onto the new jack and removable board 28 when the new jack is installed back into monitor 60.

FIGS. 11 and 12 show another embodiment of the multi-section monitoring unit. Unlike the embodiment of FIGS. 1–7, the removable member 26 in this embodiment does not include a board. The jack 62 is attached to the monitoring unit 60, or the terminal, via a threaded conductive member 70 (e.g., a nut) affixed to an integrated board 22 that has an internal permanent fastener 72. The front panel 64 may have an insulator 74 that separates the front panel from the conductive connector 70. The jack 62 then can be unscrewed and removed when it needs to be replaced. It would be obvious to one skilled in art that there are many other ways of attaching the jack besides using the threaded member as depicted in FIGS. 11 and 12. All conventional means of attaching the removable member fall within the scope of this invention.

Figure 13:
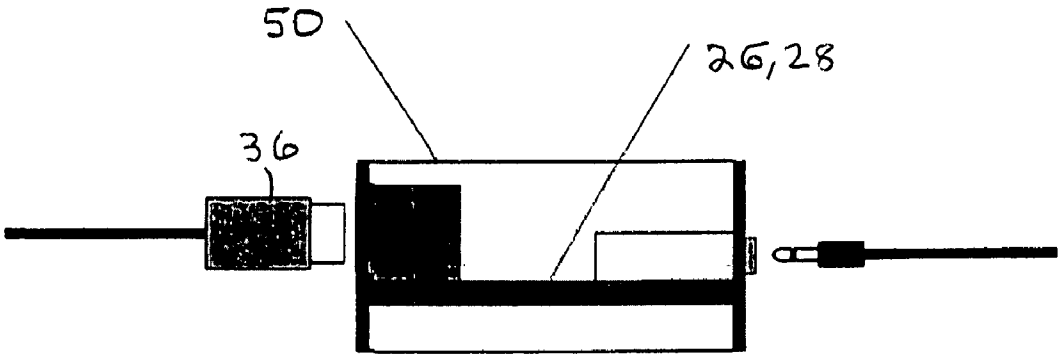
FIG. 13 depicts the remote terminal where the entire board is in one piece and is removable.
Figure 14:
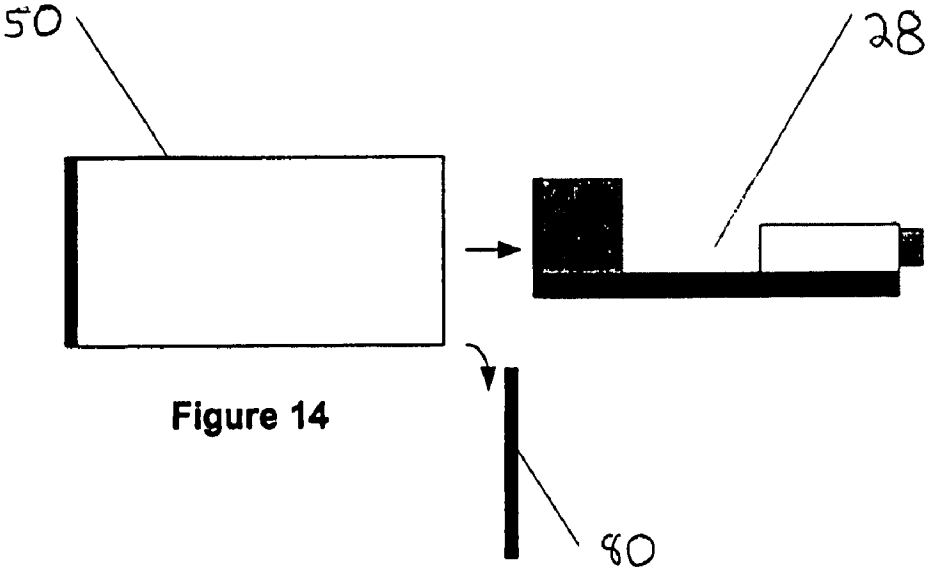
FIG. 14 depicts the terminal of FIG. 13 with the board removed.

FIGS. 13 and 14 show yet another embodiment in which the removable member 26 includes substantially all the electrical components and the jack(s) mounted on an internal board 28 of the wriststrap monitoring unit 50. If the jack fails, the removable member is replaced while the enclosure is recycled or reused as shown in FIG. 14 when a side panel 80 of the enclosure 50 is removed. The embodiment of FIGS. 13 and 14 is especially economically advantageous if there are only few components on the board or the components are cheap, such that the removable member is relatively inexpensive. In accordance with the invention, in all of the embodiments shown, the need to unsolder and resolder the jack to the board is avoided.

While the foregoing has been with reference to a particular embodiment of the invention, it will be appreciated by those skilled in the art that changes in this embodiment may be made without departing from the principles and spirit of the invention, the scope of which is defined by the appended claims.

The invention claimed is:

1. A connector assembly for a wriststap monitor, comprising:

an integrated member having a mating connector and a monitor connector;

a removable member having a second mating connector and a jack into which a wriststrap connector may be plugged; and wherein the integrated member and the removable member are capable of being mechanically coupled to each other using the mating connector and the second mating connector so that the monitor connector is electrically connected to the jack through the integrated member and the removable member.

2. The connector assembly of claim 1 further comprising an enclosure that houses the integrated member and removable member.

3. The connector assembly of claim 2, wherein the enclosure further comprises a removable front panel.

4. The connector assembly of claim 1, wherein the second mating connector further comprises a threaded conductive member that is threaded into the mating connector to couple the integrated member to the removable member.

5. The connector assembly of claim 1, wherein the integrated member and removable member each further comprise a board wherein the boards of the integrated member and removable member are coupled together.

6. A connector assembly for a wriststrap monitor, comprising:

an integrated member;

a removable member having a monitor connector and a jack into which a wriststrap connector may be plugged, the monitor assembly and jack being electrically coupled; and wherein the integrated member and removable member are removably coupled to each other.

7. The connector assembly of claim 6, wherein the integrated member further comprises an enclosure.

8. The connector assembly of claim 7, wherein the enclosure further comprises a removable front panel.

9. A method for replacing a wriststrap jack for an wriststrap monitor, the method comprising:

removing a jack assembly from the wriststrap monitor, the jack assembly including the wriststrap jack; and inserting a new jack assembly into the wriststrap monitor without soldering in order to replace the wriststrap monitor jack.

10. A wriststrap monitor, comprising:

a monitor that monitors the voltage associated with a wriststrap;

a jack assembly that is capable of connecting the wriststrap to the monitor, the jack assembly being removably connected to the monitor so that the jack assembly is replaceable without soldering.

11. The monitor of claim 10 further comprising an integrated member having a mating connector and a monitor connector, wherein the jack assembly further comprises a second mating connector and a jack into which a wriststrap connector may be plugged, and wherein the integrated member and the jack assembly are capable of being mechanically coupled to each other using the mating connector and the second mating connector so that the monitor connector is electrically connected to the jack.

12. The monitor of claim 11 further comprising an enclosure that houses the integrated member and jack assembly.

13. The monitor of claim 12, wherein the enclosure further comprises a removable front panel.

14. The monitor of claim 11, wherein the second mating connector further comprises a threaded conductive member that is threaded into the mating connector to couple the integrated member to the removable member.

* * * * *